US006817107B1

(12) United States Patent
Rabalais, Jr.

(10) Patent No.: US 6,817,107 B1
(45) Date of Patent: Nov. 16, 2004

(54) BATTER BOARD APPARATUS

(76) Inventor: Kirby N. Rabalais, Jr., 20 James St., Coldspring, TX (US) 77331

( * ) Notice: Subject to any disclaimer, the term of this patent is extended or adjusted under 35 U.S.C. 154(b) by 0 days.

(21) Appl. No.: 10/654,311

(22) Filed: Sep. 4, 2003

(51) Int. Cl.[7] ..... E04G 21/18

(52) U.S. Cl. ..... 33/405; 33/1 LE

(58) Field of Search ..... 33/405, 1 G, 1 H, 33/495, 498, 404, 1 LE; 256/65.04, 65.05, 65.06

(56) References Cited

U.S. PATENT DOCUMENTS

| | | | | | |
|---|---|---|---|---|---|
| RE24,044 | E | * | 7/1955 | Breuninger | 33/405 |
| 3,381,379 | A | * | 5/1968 | Fergen | 33/1 LE |
| 3,823,480 | A | * | 7/1974 | Grundman | 33/409 |
| 4,080,739 | A | * | 3/1978 | Ruhaak | 33/405 |
| 5,547,169 | A | * | 8/1996 | Russell | 256/67 |
| 6,178,651 | B1 | * | 1/2001 | Yancey | 33/405 |
| 6,490,803 | B1 | * | 12/2002 | Butters | 33/405 |

FOREIGN PATENT DOCUMENTS

| | | | |
|---|---|---|---|
| DE | 4315654 A1 * | 11/1994 | E04G/21/18 |

* cited by examiner

*Primary Examiner*—Stephen D. Meier
*Assistant Examiner*—R. Alexander Smith
(74) *Attorney, Agent, or Firm*—Bill B. Berryhill

(57) ABSTRACT

Batter board apparatus for use in building construction, including first and second sleeve members hingedly connected and adapted to slidingly receive first ends of first and second elongated board members, respectively, for hinged movement between parallel positions adjacent each other and positions mutually perpendicular to each other. The first and second sleeve members are provided with a common tubular member the axis of which is perpendicular to their hinged movements. Third and fourth sleeve members, adapted to receive second ends of the first and second elongated boards, respectively are also provided. Each of the third and fourth sleeve members are provided with a tubular member the axis of which would be perpendicular to the elongated board members when engaged thereby. Three rod members, one for each of said tubular members and which may be driven into the ground for engagement by one of the tubular members to support the apparatus and board members in a generally L-shaped disposition substantially horizontal to the ground.

9 Claims, 2 Drawing Sheets

BATTER BOARD APPARATUS

BACKGROUND OF THE INVENTION

1. Field of the Invention

The present invention pertains to apparatus used in the construction of buildings. More specifically, the present invention pertains to batter board apparatus for use in positioning and locating building foundations and walls.

2. Background of the Invention

One of the initial steps in a construction project is the delineation of building corners and walls. In so doing; the comers and walls are located with lines or cords strung from devices commonly known in the industry as batter boards. Batter boards are positioned at every comer of the proposed building locations and the lines or cords are attached to the batter boards and strung to positions representing the outside dimensions of the building foundation and/or walls. The lines are arranged to define perfectly square corners and a true level horizontal plane.

For perhaps centuries, batter boards have been constructed in very primitive manners by nailing wooden strips to upright wooden posts or stakes driven into the ground near the comers of the proposed building. Nails are driven into the wooden strips and strings are pulled or strung between nails to properly define the corners and establish a true horizontal plane. There are several problems associated with such construction. For one, each end of the post must be sharpened to facilitate driving into the ground. Posts are easily damaged or destroyed while being driven into the ground. In fact, most of the wooden materials are so damaged that upon completion of one project they will be thrown away because they are not reusable.

In recent years improvements have been made in the construction and materials of batter boards primarily to facilitate the installation and reuse of the batter boards. Some of the improved batter boards are shown in U.S. Pat. Nos. RE. 24,044; 4,080,739 and 6,178,651. While such improved batter boards are easier to install and are at least to some extent reusable, they are generally cumbersome, not easily available to the ordinary construction worker and are not readily storable and easily transported for future jobs. Further improvements are desired.

SUMMARY OF THE PRESENT INVENTION

The present invention provides batter board apparatus for use in building construction which is easily installed and used and which could be made readily available to the ordinary carpenter or construction worker. It is easily manufactured and assembled, easy to use and would be available at a very low cost.

The apparatus of the present invention comprises a pair of sleeve members hingedly connected and adapted to slidingly receive the ends to a pair of respective board members such as a pair of 1×4's or 2×4's. Two other separate sleeve members are provided and adapted to receive the opposite ends of the elongated board members. The hinged pair of sleeve members are provided at their hinged connection with a common tubular member, the axes of which is perpendicular to the hinged movement thereof. The two other sleeve members are also provided with tubular members, the axis of which would be perpendicular to the elongated board members when engaged thereby. The apparatus also includes three rod members, one for each of the tubular members, which may be driven into the ground and the upper ends of which are engageable with respective ones of the tubular members to support the apparatus and the elongated board members in a generally L-shaped disposition substantially horizontal to the ground.

After use, and upon disengagement from the rod members, the sleeve members, while engaged by the opposite ends of the elongated board members, may be pivoted about the hinged connection so that the board members lie side by side allowing all the sleeves and the boards to be transported as a combined unit.

Thus, the batter board apparatus of the present invention is easily installed, utilizing rod members which are not easily damaged or destroyed and which are easy to remove upon completion of the job. The sleeves and rods of the apparatus of the present invention could be sold and provided in a combined package and the apparatus would be completed by provision of two elongated board members, e.g. 1×4's or 2×4's, which would be provided by the purchaser or actually on the job.

A preferred and alternate embodiment are described hereafter which will illustrate other objects and advantages of the invention. Descriptions will follow in conjunction with the accompanying drawings.

DESCRIPTION OF PREFERRED EMBODIMENTS

Figure 1:
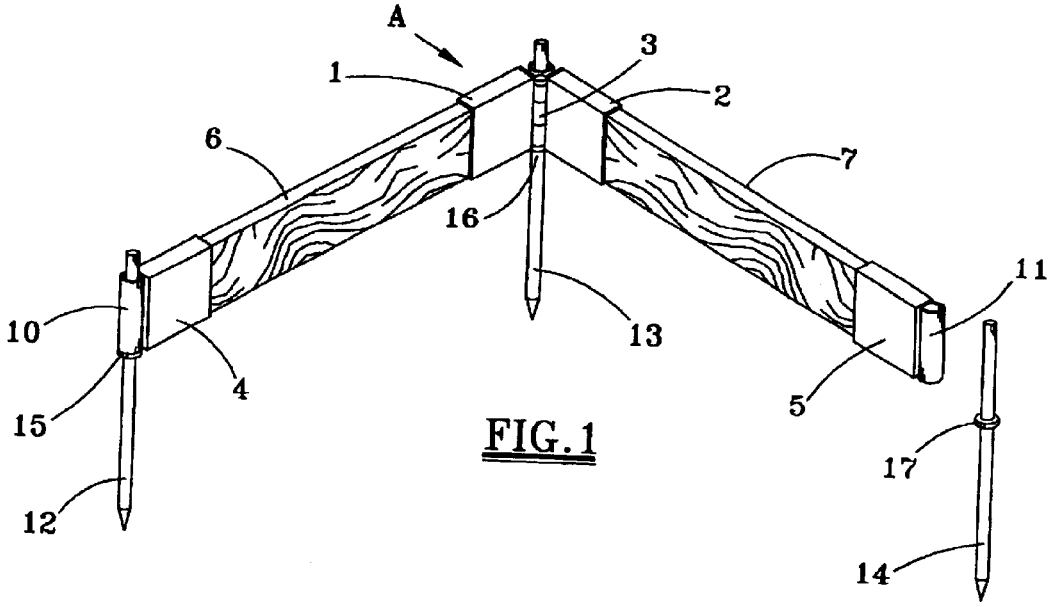
FIG. 1 is a pictorial representation of batter board apparatus for use in building construction, according to a preferred embodiment of the invention.
Figure 4:
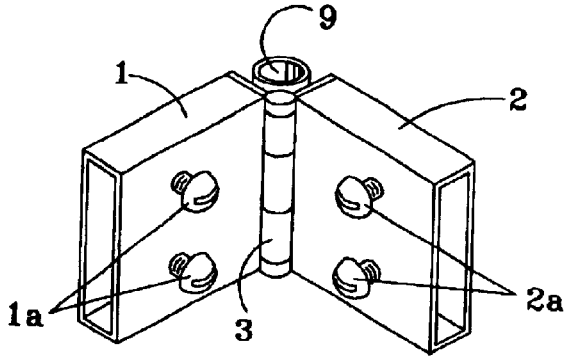
FIG. 4 is a perspective view of a hinged pair of sleeve members which form a part of the batter board apparatus of FIG. 1.

Referring first to FIG. 1, there is shown a batter board apparatus A of the present invention comprising a number of components. Referring also to FIG. 4, the apparatus includes first and second sleeve members 1 and 2 hingedly connected at 3 for articulated movement thereabout The sleeve members 1 and 2 may be made of metal, plastic or any suitable material, rectangular in cross-section, adapted to slidingly receive first ends of first and second elongated board members 6, 7, respectively. The board members 6 and 7 may conveniently cut from 1×4 or 2×4 lumber. The first and second sleeve members 1 and 2 are provided at the hinged connection 3 with a common tubular member 9, the axis of which is perpendicular to the hinged movement of sleeve 1 and 2.

Figure 3:
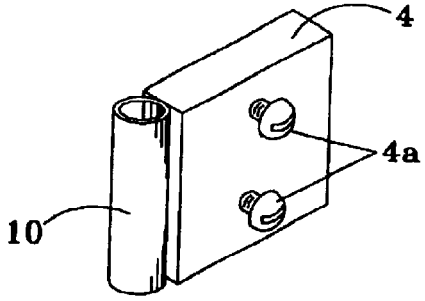
FIG. 3 is a perspective view of one of the sleeve members which forms a portion of the batter board apparatus of FIG. 1.

Third and fourth sleeve members, 4 and 5, with cross-sections similar to the cross- sections of sleeves 1 and 2 are provided and adapted to receive second ends of the first and second elongated board members 6 and 7. The third and fourth sleeve members are provided with a tubular members 10, 11 the axes of which would be perpendicular to the elongated board members when engaging the sleeve members. FIG. 3 further illustrates one of these, i.e. the third sleeve member 4.

If desired the sleeves 1, 2, 4, 5 may be provided with one or more set screws such as 1*a*, 2*a* in FIG. 4 and 4*a* in FIG. 3. These set screws may be used to secure the sleeves 1, 2, 4 and 5 to the ends of board members 6, 7 when engaged thereby.

Figure 5:
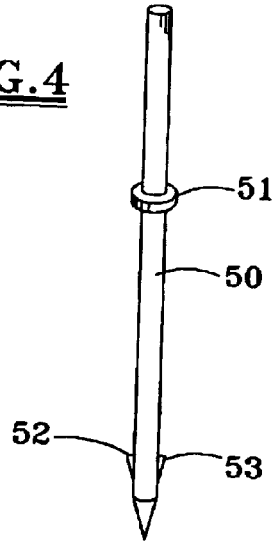
FIG. 5 is a longitudinal view of one of the rod members of the batter board apparatus of FIG. 1.
Figure 5:
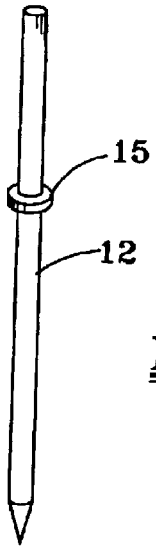

The apparatus also includes three rod members, 12, 13 and 14, one for each of the tubular members 6, 7 and 9. These rod members, 12, 13, 14 are preferably steel rods the lower ends of which are pointed and which may be driven into the ground. Each of the rod members 12, 13 and 14 is provided, at a predetermined distance from the upper ends thereof with a stop surface 15, 16, 17. The stop surface may be provided by a washer welded to the rod or any other suitable stop element or surface. See FIG. 5 which shows one of these rods 12. After being driven into the ground, the upper ends of the rod members 12, 13 and 14 are engageable with one of the tubular members 9, 10 and 11 to support the apparatus A and the first and second elongated board members 6 and 7 in a generally L-shaped disposition substantially horizontal to the ground.

Figure 7:
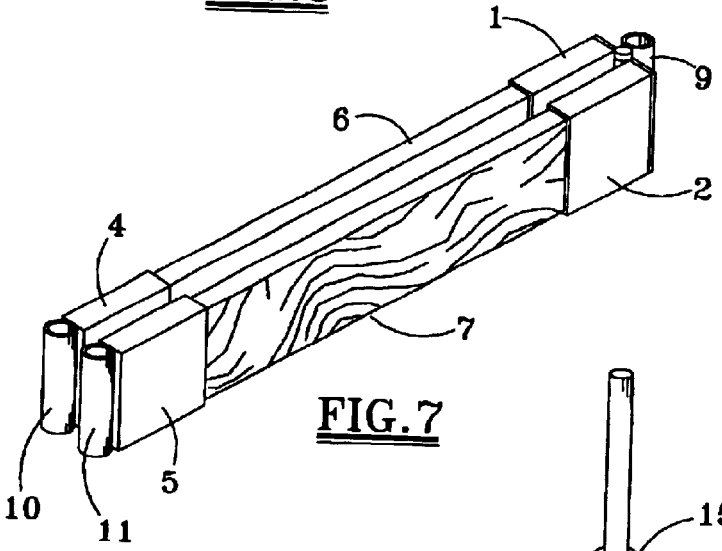
FIG. 7 is a perspective view of a portion of the batter board of the present invention folded for transport, according to a preferred embodiment of the invention.

It should be noted that when the rod members disengage from the respective tubular members 9, 10 and 11, the first, second, third and fourth sleeve members, 1, 2, 4, 5, while still engaged by the first and second ends of the first and second elongated board members 6 and 7 may be pivoted about the hinged connection 3 so that the first and second board members 6, 7 lie side by side as illustrated in FIG. 7. The sleeves and boards may then be transported as a combined unit to a place of use and then unfolded for engagement with the rod 12, 13 and 14.

Figure 2:
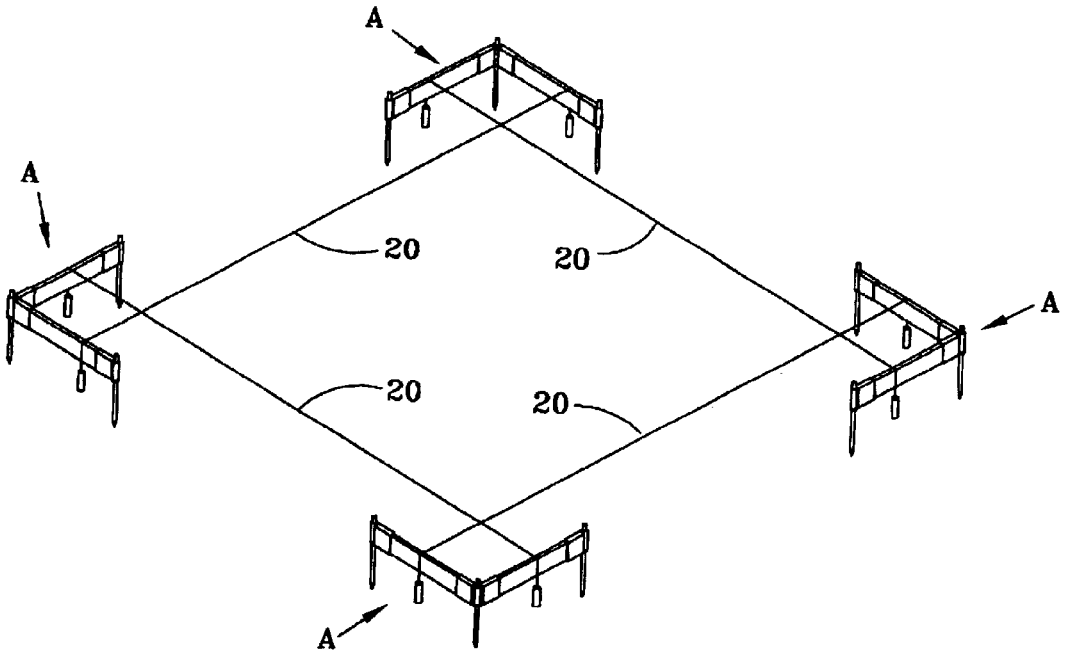
FIG. 2 is a pictorial representation, illustrating the use of batter boards, such as the batter board illustrated in FIG. 1, for laying out the construction of a building.

As illustrated in FIG. 2, several of the batter board apparatus A, four in the illustration of FIG. 2, may be used to lay out the parameters of a structure to be built and to define a horizontal level plane. In so doing, one batter board apparatus, such as shown in FIG. 1 is utilized at each comer. Lines or cords 20 may be stung from one batter board to another and positioned to define perfectly square comers at the intersection of crossing points of the lines. Using a string level (not shown) and adjusting the depth of the rods 12, 13 and 14 as needed, a horizontal level plane may be perfectly defined also. After the batter boards have served their purpose in construction of the building, the sleeves 1, 2, 4 and 5 may be disengaged from their respective rods and folded up as shown in FIG. 7. The rods may be removed from the ground and remainder of the apparatus may be easily stored or transported to another construction location.

Figure 6:
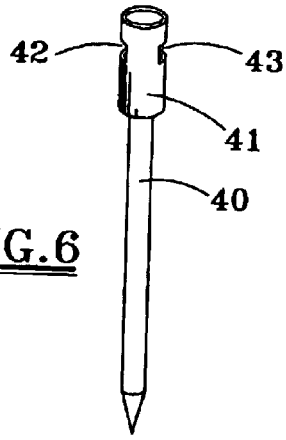
FIG. 6 is a longitudinal view of a pair of rod members, according to an alternate embodiment of the invention which may be utilized in lieu of a rod member such as the one shown in FIG. 5 to elevate the batter board apparatus of the present invention.

In some locations, the ground may vary substantially in elevation. In such cases, one or more of the rods of the apparatus A may need to be extended. In these cases an additional rod members, such as the rod 40 shown in FIG. 6, may be provided with a tubular portion 41 and driven into the ground. The tubular portion 41 may then be engaged by the lower end of another rod member 50 to raise the level of the apparatus above the ground. The rod member 50, as with the rod members 12, 13 and 14 of FIG. 1, is also provided at its upper end with a stop surface 51 against which the respective tubular member of one of the sleeves 1, 2, 4 and 5 may rest while engaging the upper portion of the rod 50. If desired, the tubular portion 41 of the rod 40 may be provided with latch recesses 42 and 43 and the lower end of the rod member 50 may be provided with upwardly tapered and outwardly biased latches 52 and 53 which upon engagement with the tubular member 41 would spring into engagement with the recesses 42 and 43. The engagement of the latches 52 and 53 with the latch recesses 42 and 43 would then assist in removal of the rod member 40 from the ground by transferring any vertical force applied to the rod member 50 to the rod member 40. In a slightly modified design the tubular portion 41 might actually be provided in the upper end of rod 40. This might require that the lower end of rod 50 be slightly reduced in diameter or the rod 40 be of a slightly larger diameter.

From the foregoing description it can be seen that the batter board apparatus of the present invention is relatively easy to assemble and install. It is extremely portable and easily carried to and removed from construction sites. It is of relatively uncomplicated construction and could be made easily available to the ordinary construction trade at economic prices and sold in a kit or assembly made readily available to the trade.

While two embodiments of the invention have been described herein, many variations can be made by those skilled in the art without departing from the spirit of the invention. Accordingly, it is intended that the scope of the invention be limited only by the claims which follow.

What is claimed is:

1. Batter board apparatus for use in building construction, said apparatus comprising:

first and second sleeve members hingedly connected and adapted to slidingly receive first ends of first and second elongated board members, respectively, for hinged movement between parallel positions adjacent each other and positions mutually perpendicular to each other, said first and second sleeve members being provided at said hinged connection with a common tubular member the axis of which is perpendicular to said hinged movement;

third and fourth sleeve members adapted to receive second ends of said first and second elongated boards, respectively, each of said third and fourth sleeve members being provided with a tubular member the axis of which would be perpendicular to said elongated board members when engaging said third and fourth sleeve members, and three rod members, one for each of said tubular members, which may be driven into the ground and of which are engageable with a respective one of said tubular members to support said apparatus and said first and second elongated board members in a generally L-shaped disposition substantially horizontal to the ground.

2. Batter board apparatus as set forth in claim 1 in which each of said rod members is provided at predetermined distance from said upper ends thereof with a stop surface against which a respective one of said tubular members will rest when engaged by said rod member.

3. Batter board apparatus as set forth in claim 1 in which said tubular member of each of said third and fourth sleeve members is located at an outer end of its respective sleeve member.

4. Batter board apparatus as set forth in claim 1 in which said first, second, third and fourth sleeve members are sized to receive the ends of 1"×4" boards.

5. Batter board apparatus as set forth in claim 1 in which said first, second, third and fourth sleeve members are sized to receive ends of 2"×4" boards.

6. Batter board apparatus as set forth in claim 1 including one or more additional rod members which may be driven into the ground and the upper end of each which is provided with a tubular portion which is engageable by a lower end of a respective one of said three rod members previously set forth in claim 1 to raise the level of said apparatus and said first and second elongated board members above the ground.

7. Batter board apparatus as set forth in claim 6 in which the lower end of at least one of said previously set forth rods is provided with one or more outwardly biased latch members which, upon engagement of said lower end of said rod member with said tubular portion provided at the upper end of a respective one of said additional rod members is engageable with one or more latch recesses of said tubular portion to assist in removal of said one of said additional rod members from the ground.

8. Batter board apparatus as set forth in claim 1 in which said first, second, third and fourth sleeve members, while engaged by the first and second ends of said first and second elongated board members but with said rod members disengaged therefrom, may be pivoted about said hinged connection so that said first and second board members lie side by side and said sleeves and boards may be transported as a combined unit.

9. Batter board apparatus as set forth in claim 1 in which each of said sleeve members is provided with one or more set screws engageable with said boards when engaged thereby to secure said sleeves to the ends of said boards.

* * * * *